US010160236B2

(12) United States Patent
Rietbergen

(10) Patent No.: US 10,160,236 B2
(45) Date of Patent: Dec. 25, 2018

(54) SHEET CONVEYOR FOR TRANSPORTING A SHEET, METHOD FOR TRANSPORTING A SHEET IN A SHEET CONVEYOR, INKJET PRINTING APPARATUS COMPRISING THE SHEET CONVEYOR

(71) Applicant: OCÉ-TECHNOLOGIES B.V., Venlo (NL)

(72) Inventor: Mark Rietbergen, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/707,592

(22) Filed: Sep. 18, 2017

(65) Prior Publication Data

US 2018/0001678 A1 Jan. 4, 2018

Related U.S. Application Data

(63) Continuation of application No. PCT/EP2016/056226, filed on Mar. 22, 2016.

(30) Foreign Application Priority Data

Mar. 25, 2015 (EP) ..... 15160687

(51) Int. Cl.
*B65H 29/52* (2006.01)
*B65H 29/70* (2006.01)
(Continued)

(52) U.S. Cl.
CPC ..... *B41J 13/103* (2013.01); *B65H 5/224* (2013.01); *B65H 5/36* (2013.01); *B65H 29/242* (2013.01);
(Continued)

(58) Field of Classification Search
CPC ..... B65H 29/52; B65H 29/70; B65H 29/242; B65H 29/54; B65H 29/56; B41J 11/0005
See application file for complete search history.

(56) References Cited

U.S. PATENT DOCUMENTS 5,975,521 A * 11/1999 Ono ..... B65H 29/70 271/188
6,503,011 B2 * 1/2003 Kono ..... B41J 13/106 271/188
(Continued)

FOREIGN PATENT DOCUMENTS

JP 01214569 A * 8/1989
JP 04323159 A * 11/1992
JP 08169610 A * 7/1996

OTHER PUBLICATIONS

International Search Report, issued in PCT/EP2016/056226, dated Jun. 3, 2016.
(Continued)

*Primary Examiner* — Luis A Gonzalez
(74) *Attorney, Agent, or Firm* — Birch, Stewart, Kolasch & Birch, LLP

(57) ABSTRACT

A sheet conveyor is provided for transporting a sheet. The sheet conveyor includes a supplying conveyor, a receiving conveyor and a sheet guidance unit. The receiving conveyor includes a support surface arranged for supporting the sheet on a contact side of the sheet and an attraction unit arranged for attracting the sheet to the support surface. The supplying conveyor includes a transport belt being arranged for advancing the sheet in a transport direction along a transport path towards the support surface of the receiving conveyor; the sheet having two side edge portions relative to the transport path. The sheet guidance unit is arranged at a downstream end of the transport path for guiding the sheet towards the receiving conveyor, wherein said sheet guidance
(Continued)

unit includes a lifting element arranged for lifting both side edge portions of the sheet away from the support surface while a middle portion of the sheet in between both side edge portions is guided towards the support surface.

18 Claims, 5 Drawing Sheets

(51) Int. Cl.

| | |
|---|---|
| ***B41J 13/10*** | (2006.01) |
| ***B65H 29/24*** | (2006.01) |
| ***B65H 5/22*** | (2006.01) |
| ***B65H 5/36*** | (2006.01) |
| ***B65H 29/66*** | (2006.01) |

(52) U.S. Cl.

CPC ..... *B65H 29/52* (2013.01); *B65H 29/66* (2013.01); *B65H 29/70* (2013.01); *B65H 2220/09* (2013.01); *B65H 2301/44735* (2013.01); *B65H 2301/517* (2013.01); *B65H 2301/51214* (2013.01); *B65H 2404/2691* (2013.01); *B65H 2404/62* (2013.01); *B65H 2511/214* (2013.01); *B65H 2513/10* (2013.01); *B65H 2701/132* (2013.01); *B65H 2801/15* (2013.01); *B65H 2801/24* (2013.01)

(56) References Cited

U.S. PATENT DOCUMENTS

| | | | | |
|---|---|---|---|---|
| 7,661,670 | B2 * | 2/2010 | Shinohara ..... | B65H 31/02 271/207 |
| 8,322,717 | B1 | 12/2012 | de Jong et al. | |
| 8,600,286 | B2 * | 12/2013 | Chiyoda ..... | G03G 15/657 399/397 |
| 2009/0212497 | A1 * | 8/2009 | Kawaguchi ..... | B65H 29/242 271/308 |
| 2010/0109235 | A1 | 5/2010 | Sugiyama et al. | |
| 2016/0152045 | A1 * | 6/2016 | La Vos ..... | B41J 11/0005 347/104 |

OTHER PUBLICATIONS

Written Opinion of the International Searching Authority, issued in PCT/EP2016/056226, dated Jun. 3, 2016.

* cited by examiner

SHEET CONVEYOR FOR TRANSPORTING A SHEET, METHOD FOR TRANSPORTING A SHEET IN A SHEET CONVEYOR, INKJET PRINTING APPARATUS COMPRISING THE SHEET CONVEYOR

CROSS REFERENCE TO RELATED APPLICATIONS

This application is a Continuation of PCT International Application No. PCT/EP2016/056226, filed on Mar. 22, 2016, which claims priority under 35 U.S.C. 119(a) to patent application Ser. No. 15/160,687.8, filed in Europe on Mar. 25, 2015, all of which are hereby expressly incorporated by reference into the present application.

FIELD OF THE INVENTION

The present invention relates to a sheet conveyor for transporting a sheet, the sheet conveyor comprising a supplying conveyor, a receiving conveyor and a sheet guidance unit. The present invention further relates to a method for transporting a sheet in a sheet conveyor. The present invention further relates to an inkjet printing apparatus for printing on a sheet comprising a sheet conveyor for transporting a sheet.

BACKGROUND ART

A known inkjet printing apparatus comprises a supplying conveyor, a receiving conveyor and a sheet guidance unit for guiding a sheet from the supplying conveyor to the receiving conveyor. The supplying conveyor, such as a print belt conveyor having a transport belt for advancing the sheet along an inkjet print station, is arranged for advancing the sheet in a transport direction towards the receiving conveyor. Said print station is arranged for applying an inkjet image onto a process side of the sheet using an ink, such as by applying dots of an aqueous ink.

The supplying conveyor may have a suction mechanism arranged for providing a suction force to attract a contact side of the sheet towards the transport belt, the contact side being opposite to the process side. As such, a force is provided for driving the sheet in the transport direction towards the receiving conveyor along with a movement of the transport belt of the supplying conveyor in the transport direction.

The receiving conveyor comprises a transport belt for transporting the sheet having a support surface for supporting the sheet in contact with the contact side of the sheet while transporting the sheet. The receiving conveyor may further comprise a suction mechanism arranged for providing a suction force to attract the contact side of the sheet towards the support surface of the transport belt of the receiving conveyor.

The sheet guidance element is arranged downstream of the supplying conveyor in the transport direction for guiding the sheet towards the receiving conveyor. The sheet guidance element comprises a guidance surface for supporting the sheet in contact with the contact side of the sheet and guiding the sheet along the sheet guidance element towards the receiving conveyor.

The guidance surface of the sheet guidance element is arranged partly over the transport belt of the receiving conveyor. Behind an end of the guidance surface in the transport direction the sheet is allowed to land on the support surface of the transport belt of the receiving conveyor.

When the printing station forms an inkjet image on the process side of the sheet by applying dots of an aqueous ink, the printed sheet becomes wet due to the aqueous ink dots. The moisture is absorbed into the sheet and enlarges the fibers of the sheet at the process side of the sheet depending on the sheet properties. As a result, the sheet may become curled at the side edges and/or the corners of the sheet.

Additionally, environmental conditions, such as a humidity of the air, may affect curling of the sheet. Said curled sheet, when leaving the sheet guidance unit, lands on the transport belt of the receiving conveyor in an undetermined way. As a result, after landing of the sheet on the support surface of the receiving conveyor and attracting the sheet to the support surface, wrinkling may occur in the sheet. These wrinkles may even become fixed in the sheet during a drying step of the printed sheet in a drying unit arranged downstream of the sheet guidance unit. As a result, the sheet may be permanently deformed by said wrinkles.

SUMMARY OF THE INVENTION

It is accordingly an object of the present invention to provide a sheet conveyor for transporting a sheet, the sheet conveyor comprising a supplying conveyor and a receiving conveyor, which sheet conveyor prevents or at least diminishes wrinkling of said sheet during transport of the sheet onto a support surface of the receiving conveyor.

The present invention provides a sheet conveyor for transporting a sheet, the sheet conveyor comprising a supplying conveyor, a receiving conveyor and a sheet guidance unit; the receiving conveyor comprising a support surface arranged for supporting the sheet on a contact side of the sheet and an attraction unit arranged for attracting the sheet to the support surface; the supplying conveyor being arranged for advancing the sheet in a transport direction along a transport path towards the support surface of the receiving conveyor; the sheet having two side edge portions relative to the transport path; the sheet guidance unit being arranged at a downstream end of the transport path for guiding the sheet towards the receiving conveyor, wherein said sheet guidance unit comprises a lifting element arranged for lifting both side edge portions of the sheet away from the support surface while a middle portion of the sheet in between both side edge portions is guided towards the support surface.

When the sheet passes the sheet guidance unit in the transport direction, the lifting element forces the sheet into an upwards curved shape by lifting both side edge portions of the sheet. The result is that the middle portion of the sheet is guided onto the support surface of the receiving conveyor first. The attraction unit attracts the middle portion of the sheet onto the support surface of the receiving conveyor. The middle portion of the sheet, which is attracted on the support surface of the receiving conveyor, is transported further by the receiving conveyor in the transport direction, while the side edge portions of the sheet are lifted by the lifting element away from the support surface. As such, the side edge portions of the sheet will land onto the support surface of the receiving conveyor a certain distance further in the transport direction. It has been found, that in this way wrinkling of the sheet on the support surface of the receiving conveyor is prevented or at least reduced, because substantially no wrinkles will develop in the sheet due to landing and attraction of the sheet onto the support surface of the receiving conveyor.

As defined herein the side edge portions and the middle portion of the sheet are defined with respect to the transport direction of the transport path.

The supplying conveyor may comprise a transport belt for advancing the sheet in the transport direction along the transport path. Alternatively the supplying conveyor may comprise a rotatable drum comprising an outer circumferential surface for supporting the sheet, which rotatable drum is arranged for advancing the sheet in the transport direction along the transport path. In this embodiment the transport path of the sheet extends in the shape of a circular arc, which is concentrically arranged with respect to the rotatable drum.

In an embodiment, the lifting element is at least partly arranged over the support surface of the receiving conveyor. This arrangement enhances the landing and the attraction of the middle portion of the sheet onto the support surface prior to the landing and the attraction of the side edge portions of the sheet onto the support surface of the receiving conveyor. This arrangement is advantageous for preventing wrinkling in sheets by controlling the landing of the sheet on the support surface independently of a length of the respective sheet in the transport direction. In an example, the sheet may extend over a relatively small distance in the transport direction (i.e. having a relatively small length in the transport direction), wherein said sheet is controllably guided by the sheet guidance unit onto the support surface of the receiving conveyor.

In an embodiment, the lifting element comprises two lifting parts cooperatively arranged along the sides of the transport path for lifting both side edge portions of the sheet away from the support surface. The two lifting parts may be connected to one another and may be not connected to each other. The two lifting parts may be suitably arranged at a certain pitch between one another in a transverse direction such that both side edge portions of the sheet are lifted away from the support surface.

In an embodiment, a length of a first lifting part in the transport direction increases towards the side edge of the transport path. As such the sheet is curved upwards in the transverse direction towards the side edges of the sheet. As a result the landing of the sheet on the support surface gradually develops from the middle portion of the sheet to the side edges of the sheet.

In an embodiment, the supplying conveyor comprises a transport belt for advancing the sheet in the transport direction along the transport path and a deflection element arranged at the downstream end of the transport path for deflecting the transport belt close to the sheet guidance unit. The deflection element supports separation of the sheet from the transport belt of the supplying conveyor and transfer of the sheet to the sheet guidance unit. The deflection element is arranged upstream of the sheet guidance unit in the transport direction. A curvature of the deflection element may be suitably selected for separating the sheet from the transport belt at the end of the transport path. The deflection element may be a deflection roller and may be a curved plate.

In an embodiment, the sheet guidance unit comprises a separation edge for separating the sheet from the transport belt, which separation edge is arranged at a distance of about 1 mm or less from the transport belt. The separation edge supports separation of the sheet from the transport belt in addition to a deflection element.

In an embodiment, a first lifting part is tilted around a tilting axis with respect to the support surface, wherein the tilting axis is arranged substantially parallel to the plane of the transport path at an angle with respect to the transport direction for gradually lifting a first side edge portion. The tilting axis may be disposed in the plane of the transport path, may be disposed below the plane of the transport path relative to the lifting direction or may be disposed above the plane of the transport path relative to the lifting direction. Said first lifting part may be a lifting plate, and may be a box structure comprising a lifting face arranged for gradually lifting a first side edge portion.

The tilting axis is arranged at an angle with respect to the transport direction, such being orthogonal arranged relative to the transport direction. In a particular embodiment the tilting axis is arranged at an acute angle relative to the transport direction. As a result a first side edge portion of the sheet is gradually lifted away from the support surface of the receiving conveyor.

In an embodiment, the first lifting part is rotatably arranged around the tilting axis and the sheet guidance unit comprises an adjusting device arranged for adjusting a tilting angle of the first lifting part around the tilting axis with respect to the support surface. The lifting part may be supported by an axle or a hinge element. Said axle or hinge element may substantially coincide with the tilting axis of the lifting part and, accordingly, the first lifting part is rotatably arranged around the tilting axis by said axle or said hinge element.

The adjusting device may comprise an actuator, such as a rotary driving device, for adjusting the tilting angle of the first lifting part around the tilting axis. The adjusting device may further comprise a sensing unit, such as an encoder, for sensing the tilting angle of the lifting part and a control unit for controlling the actuator.

In a particular embodiment, the sheet guidance unit comprises a common shaft disposed for rotatably arranging both lifting parts around a common tilting axis, which coincides with the common shaft, and comprises a rotary actuator connected to the common shaft and arranged for adjusting the tilting angle of both lifting parts around the tilting axis.

In another embodiment, the first lifting part is rotatably arranged around the tilting axis and the sheet guidance unit comprises a spring mechanism for urging the first lifting part to a predetermined tilting angle around the tilting axis with respect to the support surface, the spring mechanism applying a predetermined spring force on the first lifting part, such that the tilting angle of the first lifting part with respect to the support surface is elastically reduced depending on the sheet type due the moving sheet contacting the first lifting part.

In this embodiment the tilting angle is temporarily reduced with respect to the support surface depending on the sheet type.

The predetermined spring force is selected such that a sheet may temporarily adjust the tilting angle towards the support surface in response to the moving sheet contacting the first lifting part. The sheet type may be a sheet size, may be a thickness of a sheet, may be a stiffness of a sheet, and may be a combination of these attributes.

For example the predetermined spring force angle is selected high enough to lift a relatively flexible sheet from the support surface of the receiving conveyor at the predetermined tilting angle, while the selected predetermined spring force is low enough, such that a relatively stiff sheet temporarily reduces the tilting angle of the first lifting part towards the support surface at the moment of guiding the relatively stiff sheet to the receiving conveyor. As a result, in case of guiding a relatively stiff sheet, a transport friction of the sheet with respect to the sheet guidance unit is decreased. It has been found that lifting the side edge portion is not as necessary for a relatively stiff sheet, because wrinkling of the sheet is less present in case of a relatively stiff sheet.

In an embodiment, the tilting axis of the first lifting part is arranged substantially perpendicular to the transport direction. This supports a simple arrangement of the lifting element relative to the supplying conveyor. For example the lifting part may have a separation edge arranged substantially perpendicular to the transport direction and arranged proximate to the transport belt of the supplying conveyor for separating the sheet from the transport belt, wherein the separation edge substantially coincides with the tilting axis of the first lifting part.

In an embodiment, the tilting axis of the first lifting part is arranged at an acute angle with respect to the transport direction. This arrangement supports a gradually lifting of the side edge portion starting at the side edges.

In an example the sheet guidance unit may further comprise a guidance surface connected to both lifting parts and arranged for guiding the middle portion of the sheet over said guidance surface in between both lifting parts. A structure of both lifting parts, having said tilting axis arranged at said acute angle with respect to the transport direction, and said guidance surface enhances a controlled guiding of the all portions of the sheet towards the receiving conveyor. In this embodiment a rear edge of the first lifting part in the transport direction may be arranged adjoining to a rear edge of the guidance surface.

In an embodiment, the sheet guidance unit comprises a friction reducing part arranged for reducing friction to the sheet, the friction reducing part preferably being in the form of an assembly of protrusions. Said friction reducing part enhances a reliable transport of the sheet towards the receiving conveyor. As a result, the orientation of the sheet relative to the transport direction is maintained accurately (e.g. no slanting errors introduced). For example the lifting element comprises a friction reducing part arranged for reducing friction to the sheet.

In an embodiment, the support surface of the receiving conveyor is arranged for transporting the sheet along a second transport path arranged at an acute angle with respect to the transport path of the supplying conveyor. The acute angle enhances the reduction of wrinkling of the sheet on the receiving conveyor.

In an embodiment, the two lifting parts are not connected to each other. This structure provides an independent and adjustable arrangement of each lifting part with respect one another and supports accurate arrangement of each lifting part relative to the transport belt of the supplying conveyor.

In another aspect of the present invention an inkjet printing apparatus is provided for printing on a sheet, comprising an inkjet print head assembly arranged for applying an inkjet image on the sheet; and a sheet conveyor according to the present invention, wherein the sheet guidance unit is arranged downstream of the inkjet print head assembly.

In an embodiment, the receiving conveyor is part of a drying unit arranged for drying the sheet supported on the receiving conveyor. The sheet conveyor of the present invention prevents the development of wrinkles in the sheet on the receiving conveyor. As such the drying unit comprising said receiving conveyor is suitable to dry the sheet supported on the receiving conveyor without adding and fixing wrinkles in the sheet in response to the drying of the sheet.

In another aspect of the present invention a method is provided for transporting a sheet in a sheet conveyor, the sheet conveyor comprising a supplying conveyor and a receiving conveyor, the method comprising the steps of: advancing the sheet arranged on the supplying conveyor along a transport path in a transport direction to the receiving conveyor; guiding the sheet towards a support surface of the receiving conveyor; and attracting the sheet onto the support surface while advancing the sheet by a movement of the support surface of the receiving conveyor along a second transport path; wherein the guiding step comprises a step of lifting both side edge portions of the sheet away from the support surface of the receiving conveyor, the two side edge portions of the sheet being relative to the transport path, while guiding a middle portion of the sheet in between both side edge portions towards the support surface.

When guiding the sheet towards the support surface of the receiving conveyor, the sheet is forced into an upwards curved shape by lifting both side edge portions of the sheet away from the support surface. The result is that the middle portion of the sheet is guided onto the support surface of the receiving conveyor first. The middle portion of the sheet is attracted onto the support surface of the receiving conveyor. The middle portion of the sheet, which is attracted on the support surface of the receiving conveyor, is advanced further by the receiving conveyor in the transport direction along the second transport path, while the side edge portions of the sheet are lifted by the lifting element away from the support surface. The side edge portions of the sheet will land onto the support surface a certain distance further in the transport direction. In this way wrinkling of the sheet on the support surface of the receiving conveyor is prevented or at least reduced, because substantially no wrinkles will develop in the sheet due to landing and attraction of the sheet onto the support surface of the receiving conveyor.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

Hereinafter, the present invention is further elucidated with reference to the appended drawings showing non-limiting embodiments and wherein.

DETAILED DESCRIPTION OF EMBODIMENTS

Figure 1:
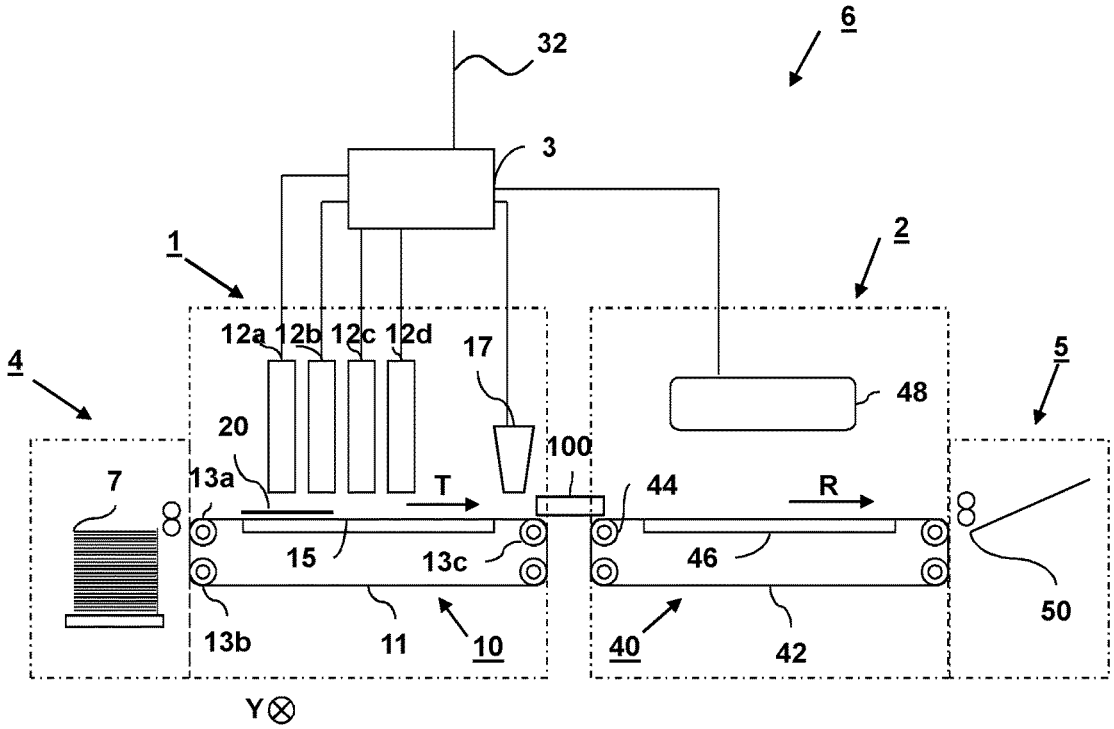
FIG. 1 shows a cut sheet image forming system, wherein printing is achieved using a inkjet printing system.

The present invention will now be described with reference to the accompanying drawings, wherein the same reference numerals have been used to identify the same or similar elements throughout the several views.

In FIG. 1 an inkjet printing system 6 is shown. The inkjet printing system 6 comprises an inkjet marking module 1, an inkjet print drying module 2 and a data controller 3. The controller is connected to a network through a network cable 32. The print data enters the controller through the network and is further processed. The print data can be saved on a non-volatile memory like a hard disk and sent to the inkjet marking module 1 using an interface board.

A cut sheet supply module 4 supplies a sheet 20 to the inkjet marking module 1. In the cut sheet supply module 4 the sheet is separated from a pile 42 and brought in contact with the transport belt 11 of the supplying conveyor 10 of the inkjet marking module 1. The supplying conveyor further comprises an assembly of belt rollers 13.

The inkjet marking module 1 comprises an assembly of four color inkjet print heads 12. The transport belt 11 transports the receiving medium to the area beneath the four color inkjet print heads 12. The colors provided by the inkjet print heads 12 is black, cyan, magenta and yellow. When receiving the print data, the inkjet print heads 12 each generate droplets of inkjet marking material and position these droplets on the sheet 20. The transport belt 11 is transported by the assembly of belt rollers 13. The transport belt 11 is transported by one roller belt roller 13*a* in the transport direction of S, and the position of the transport belt 11 in the direction y is steered by means of another belt roller 13*b*. The transport belt 11 comprises holes and the sheet 20 is held in close contact with said belt 11 by means of an air suction device 15.

After the inkjet marking material has been printed on the sheet, the sheet is moved to an area beneath a scanner module 17. The scanner module 17 determines the position of each of the four color images on the sheet 20 and sends this data to the data controller 3.

The sheet is transported to by the supplying conveyor 10 along a transport path towards a receiving conveyor 40 of the inkjet print drying module 2. The receiving conveyor 40 of inkjet print drying module 2 comprises a transport belt 42, which is transported by an assembly of belt rollers 44 in a transport direction R. The sheet 20 is dried on the belt by means of a heating plate 46, thereby evaporating the liquid of the inkjet marking material. The evaporated liquid is condensed in the condenser 48. The dried print product is made available on a tray 50 in the print storage module 5. In between the supplying conveyor 10 and the receiving conveyor 40 a sheet guidance unit 100 is arranged, at the end of the transport path where the sheet is separated from the supplying conveyor 10, for guiding a sheet from the supplying conveyor 10 to the receiving conveyor 40. Said sheet guidance unit 100 may for example be the sheet guidance unit according to the present invention.

Figure 2A:
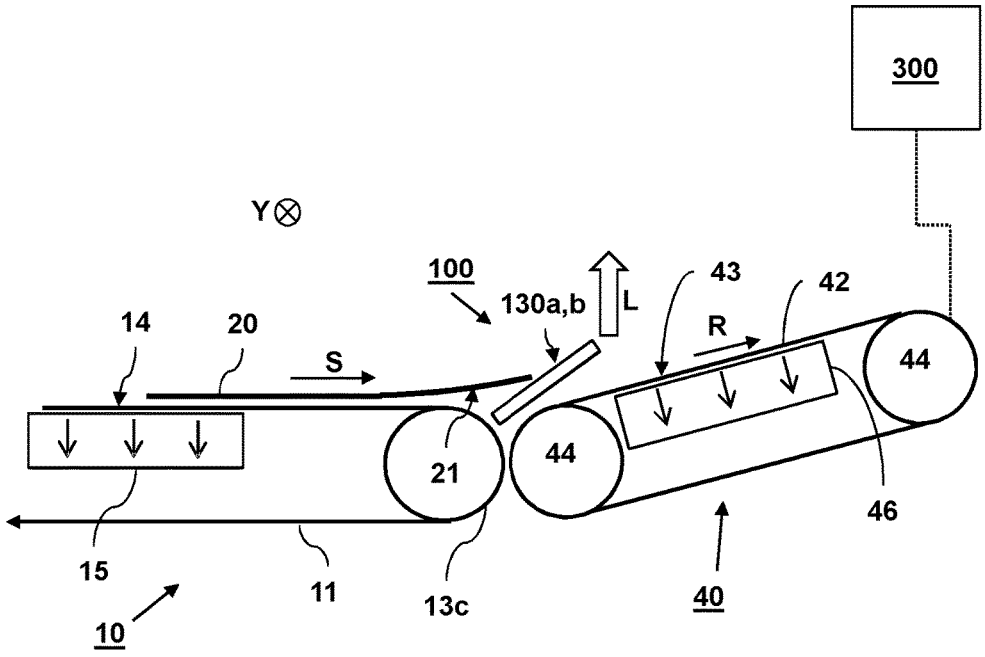
FIGS. 2A-2C show an embodiment of a sheet conveyor according to the present invention.
Figure 2B:
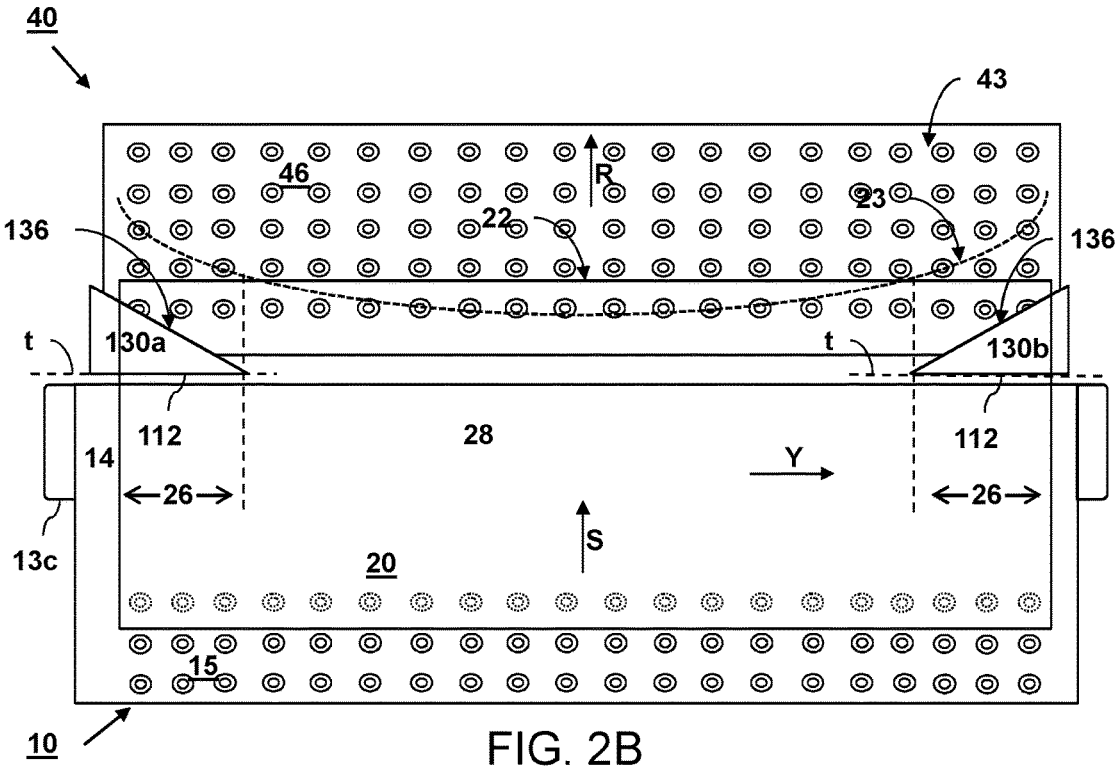
Figure 2C:
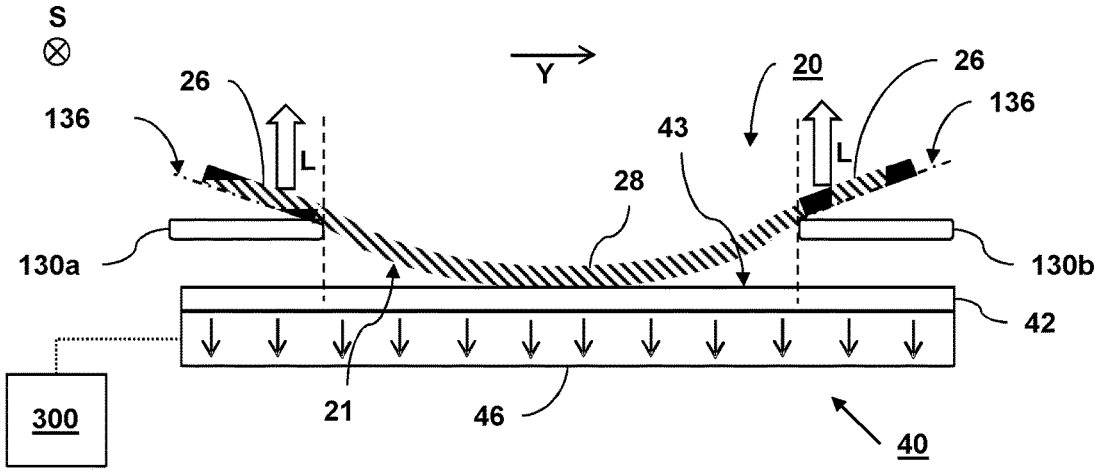

Now referring to FIGS. 2A-2C an embodiment is shown of a sheet conveyor according to the present invention. The sheet conveyor comprises a supplying conveyor 10, a receiving conveyor 40 and a sheet guidance unit 100.

FIG. 2A shows an enlarged side view of both the supply conveyor 10, showing the transport belt 11 and one of the deflection rollers 13*c* of the supply conveyor 10, and the receiving conveyor 40, showing the transport belt 42 and both belt rollers 44. A sheet 20 is placed with a contact side 21 on a support surface of the transport belt 14 and advanced by the transport belt 11 in a transport direction S to a downstream end of the transport path by moving the transport belt in the transport direction S towards the deflection roller 13. The sheet is attracted to the support surface 14 of the transport belt by a suction unit 15 which is arranged adjacent to the transport belt 11 for providing a suction force through the holes of the transport belt 11 to the contact side of the sheet 21.

The sheet guidance unit 100 is arranged downstream of the transport path of the supplying conveyor 10 in the transport direction S for guiding the sheet 20 towards the receiving conveyor 40. The sheet guidance unit 100 comprises a lifting element 130*a*, 130*b* arranged for lifting both side edge portions of the sheet 26 away from the support surface 43 of the receiving conveyor 40 as indicated by arrow L.

Now referring to FIG. 2B showing a plane view on the transport belt 14 of the supplying conveyor 10, on the support surface 43 of the receiving conveyor 40 and on the sheet guidance unit 100. The lifting element comprises two lifting parts 130*a*, 130*b*, which are cooperatively arranged downstream of the supplying conveyor 10 in the transport direction S. Both lifting parts 130*a*, 130*b* are at least partly arranged over the support surface 43 of the transport belt 42 of the receiving conveyor 40. Each of the two lifting parts 130*a*, 130*b* is arranged along a side of the transport path in the transport direction S, which side of the transport path is disposed in the transverse direction Y perpendicular to the transport direction S. Each lifting part 130*a*, 130*b* is arranged for lifting a corresponding side edge portion 26 of the sheet away from the support surface 43 of the receiving conveyor 40. Each lifting part 130*a*, 130*b* comprises a rear edge 136 arranged inclined in the transport direction S towards the side of the transport path. The sheet 20 is transported by the supplying conveyor 10 along the transport path in the transport direction S towards the support surface 43 of the receiving conveyor 40. In this view the sheet 20 is held partly by the supplying conveyor 10, in part is supported by the two lifting parts 130*a*, 130*b* and in part has landed on the support surface 43 of the transport belt 42 of the receiving conveyor 40. A leading edge of the sheet 22 is moved past the rear edges 136 of the two lifting parts 130*a*, 130*b* of the sheet guidance unit 100.

The sheet 20 is separated from the transport belt 11 of the supplying conveyor 10 due to a deflection of the transport belt 11 at the deflection element 13*c*.

A middle portion 28 of the sheet 20 is guided towards the support surface 43 of the receiving conveyor 40. At the same position in the transport direction S the side edge portions 26 of the sheet 20 are lifted by the respective lifting parts 130*a*, 130*b* away from the support surface 43 of the receiving conveyor 40. As a result the middle portion 28 of the sheet at the leading edge 22 first contacts the support surface 43 (as is also shown in FIG. 2C), while the side edge portions at the leading edge 22 land on the support surface downstream in the transport direction S at a certain distance relative to the middle portion 28 (as is indicated in FIG. 2B by a landing position 23 of the leading edge 22). As a result the wrinkling of the sheet 20 on the support surface 43 is prevented or at least reduced.

The receiving conveyor 40 comprises a suction unit 46 which is arranged for providing a suction force through holes of the transport belt 42 to the contact side of the sheet 21 (shown in FIG. 2A and FIG. 2C). The control unit 300 is configured for controlling the suction pressure provided by the suction unit 46. The contact side of the sheet 21 is attracted onto the support surface 43 of the transport belt 42 in a suction area. The transport belt 42 is moved in the transport direction as indicated by arrow R, thereby moving the sheet 20 on the transport belt 42 in the transport direction R. In case the sheet 20 is attracted to the support surface 43, any wrinkles, which are present in the sheet 20, may be fixed in the sheet. As the middle portion of the sheet 28 is landed first on the transport belt 42 substantially no wrinkles will develop in the sheet 20. In particular the lifting parts 130*a*,

130*b* correct any downward curl deformation of the sheet by lifting both side edge portions 26, while the middle portion 28 of the sheet is allowed to land on the support surface of the transport belt 42 of the receiving conveyor 40.

As shown in FIG. 2B each of the two lifting parts further comprises a separation edge 112 arranged for separating the side edge portions 26 from the transport belt 11.

The respective separation edges 112 may be arranged contacting the support surface 14 of the transport belt 11 or may be arranged at a close distance of the transport belt 11, such as about 0.1-1 mm from the transport belt 11, downstream of the deflection element 13*c*. The separation edges 112 have a tapered shape for guiding the leading edge 22 of the sheet onto the sheet guidance unit 100.

In case corners of the sheet 20 at the leading edge 22 are curled downwards towards the transport belt 11, the separation edges 112 guide the corners of the sheet 20 onto the lifting part 130*a*, 130*b* of the sheet guidance unit 100.

In this embodiment each lifting part 130*a*, 130*b* is a lifting plate having a tilting axis t, which is arranged coinciding with the separation edge 112. The lifting part 130*a*, 130*b* is tilted around the tilting axis t with respect to the support surface 43, wherein the tilting axis t is arranged in a plane parallel to the transport path substantially perpendicular with respect to the transport direction S for gradually lifting the side edge portions 26.

Now referring to FIG. 2C, which shows a cross section of the sheet 20 through the lifting parts 130*a*, 130*b* and the support surface 43 of the transport belt 42 of the receiving conveyor 40 in the transverse direction Y. In FIG. 2C the effect of the lifting parts 130*a*, 130*b* is shown on the landing of the sheet 20 on the support surface 43 of the transport belt 42 of the receiving conveyor 40.

The lifting parts 130*a*, 130*b* are arranged in part above the transport belt 42 of the receiving conveyor 40. The middle portion of the sheet 28 is landed with its contact side 21 on the support surface 43 of the transport belt 42 and is attracted to the support surface 43 by a suction force, which is provided by the suction unit 46 through holes in the transport belt 42.

The side edge portions 26 of the sheet are supported on the lifting parts 130*a*, 130*b* and are lifted away from the transport belt 42 as indicated by arrow L. The side edge portions 26 are curved upwards towards the respective side edges of the sheet. A length of the lifting plates 130*a*, 130*b* in the transport direction S increases towards the side edge of the transport path, thereby upwards lifting the side edges away from the transport belt 42 (as can be seen from a dashed projection of the respective rear edges 136 on the cross section of FIG. 2C, which rear edge 136 is encountered in the transport direction S).

Thus the height in the direction L of a rear edge 136 of the lifting plates 130*a*, 130*b* above the support surface 43 increases towards the side of the transport path and, accordingly, side edges of the sheet 20 are lifted above the other parts of the sheet 20.

The suction unit 46 is controlled by control unit 300, which may control the suction unit 46 based on a sheet detection signal provided by a detector unit (not shown). In a particular embodiment (not shown) the suction unit 46 comprises chambers, wherein a first chamber for providing a suction force to the middle portion of the sheet 28 is arranged upstream relative to the transport direction R with respect to a second chamber for providing a suction force to both the side edge portions of the sheet 26 and the middle portion of the sheet 28. The suction unit in this embodiment further enhances flattening of the sheet 20 from the middle portion of the sheet 28 to the side edge portions of the sheet 26.

Figure 3A:
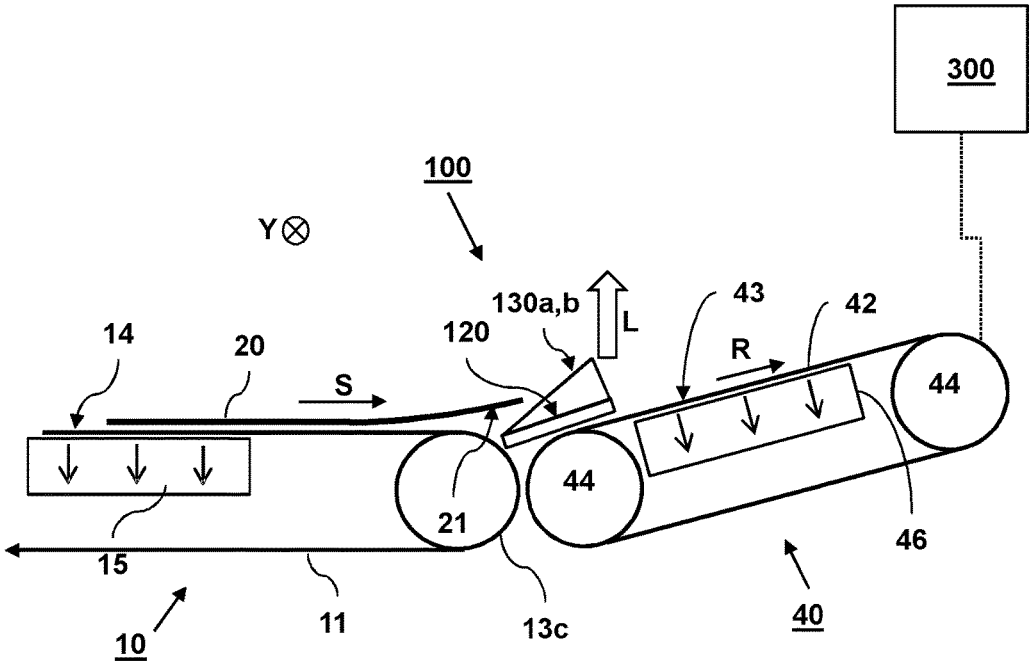
FIGS. 3A and 3B show another embodiment of a sheet conveyor according to the present invention.
Figure 3B:
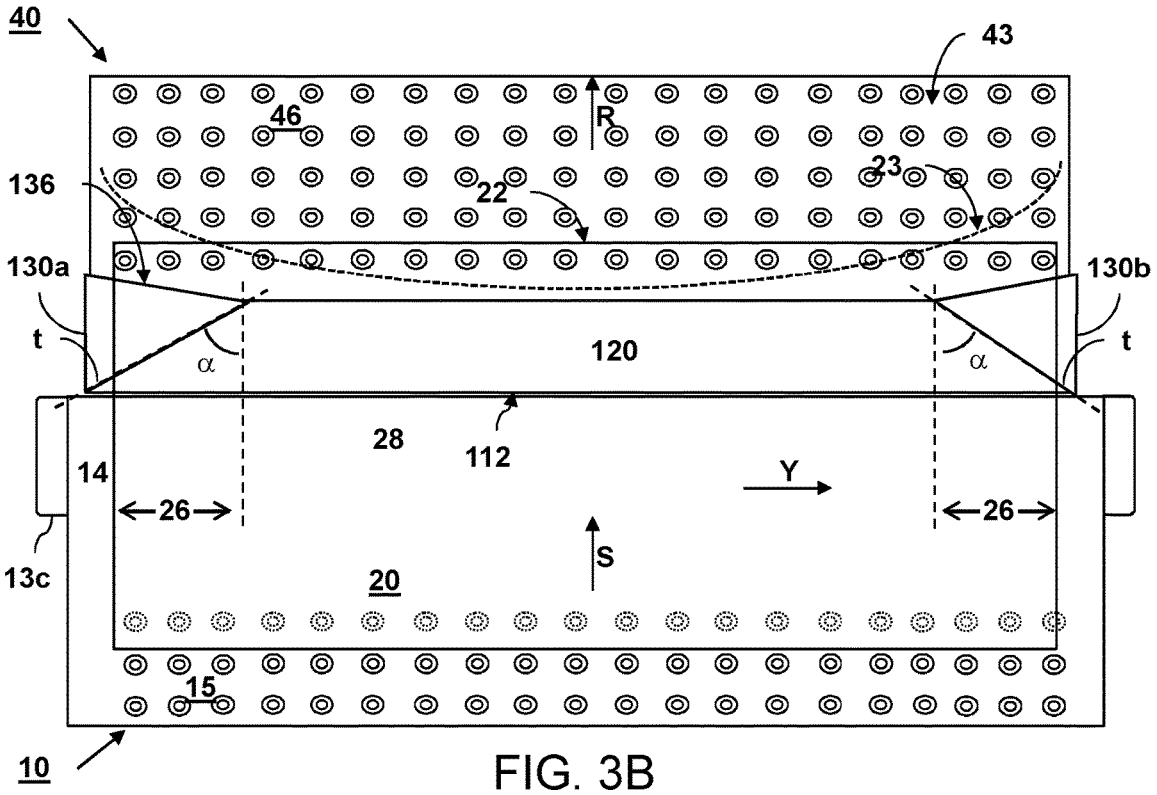

Now referring to FIGS. 3A and 3B another embodiment is shown of a sheet conveyor according to the present invention. The sheet conveyor comprises a supplying conveyor 10, a receiving conveyor 40 and a sheet guidance unit 100.

FIG. 3A shows an enlarged side view of both the supply conveyor 10, showing the transport belt 11 and one of the deflection rollers 13*c* of the supply conveyor 10, and the receiving conveyor 40, showing the transport belt 42 and the two belt rollers 44. A sheet 20 is placed with a contact side 21 on a support surface of the transport belt 14 and advanced by the transport belt 11 in a transport direction S by moving the transport belt in the transport direction S towards the deflection roller 13. The sheet is attracted to the support surface 14 of the transport belt by a suction unit 15 which is arranged adjacent to the transport belt 11 for providing a suction force through the holes of the transport belt 11 to the contact side of the sheet 21.

The sheet guidance unit 100 is arranged downstream of the supplying conveyor 10 in the transport direction S for guiding the sheet 20 towards the receiving conveyor 40.

The sheet guidance unit 100 comprises a guidance surface 120 for guiding a middle portion of the sheet 28 (as shown in FIG. 3B) and two lifting parts 130*a*, 130*b* arranged for lifting both side edge portions of the sheet 26 (as shown in FIG. 3B) away from the support surface 43 of the receiving conveyor 40 as indicated by arrow L. Both lifting parts 130*a*, 130*b* are at least partly arranged over the support surface 43 of the transport belt 42 of the receiving conveyor 40.

Now referring to FIG. 3B showing a plane view on the transport belt 14 of the supplying conveyor 10, on the support surface 43 of the receiving conveyor 40 and on the guidance surface 120 of the sheet guidance unit 100. The guidance surface extends in the transverse direction Y along the transport path.

Each of the two lifting parts 130*a*, 130*b* is arranged along a side of the transport path in the transport direction S, which side of the transport path is disposed in the transverse direction Y perpendicular to the transport direction S. Each lifting part 130*a*, 130*b* is arranged for lifting a corresponding side edge portion 26 of the sheet away from the support surface 43 of the receiving conveyor 40.

Each of the two lifting parts 130*a*, 130*b* is a lifting plate having a tilting axis t and comprises hinges arranged for connecting the respective lifting part 130*a*, 130*b* to the guidance surface 120. The lifting part 130*a*, 130*b* is tilted around the tilting axis t with respect to the support surface 43, wherein the tilting axis t is arranged in a plane parallel to the transport path at an acute angle $\alpha$ with respect to the transport direction S for gradually lifting the side edge portions 26.

The sheet 20 is separated from the transport belt 11 of the supplying conveyor 10 due to a deflection of the transport belt 11 at the deflection element 13*c*.

A middle portion 28 of the sheet 20 is guided by the guidance surface 120 towards the support surface 43 of the receiving conveyor 40. At the same position in the transport direction S the side edge portions 26 of the sheet 20 are lifted by the respective lifting parts 130*a*, 130*b* away from the support surface 43 of the receiving conveyor 40. As a result the middle portion 28 of the sheet at the leading edge 22 first contacts the support surface 43, while the side edge portions at the leading edge 22 land on the support surface downstream in the transport direction S at a certain distance relative to the middle portion 28 (as is indicated in FIG. 3B by a landing position 23 of the leading edge 22). As a result the wrinkling of the sheet 20 on the support surface 43 is prevented or at least reduced.

The receiving conveyor 40 comprises a suction unit 46 which is arranged for providing a suction force through holes of the transport belt 42 to the contact side of the sheet 21 (shown in FIG. 3A). The control unit 300 is configured for controlling the suction pressure provided by the suction unit 46. The contact side of the sheet 21 is attracted onto the support surface 43 of the transport belt 42 in a suction area. The transport belt 42 is moved in the transport direction as indicated by arrow R, thereby moving the sheet 20 on the transport belt 42 in the transport direction R. In case the sheet 20 is attracted to the support surface 43 any wrinkles, which are present in the sheet 20, may be fixed in the sheet. As the middle portion of the sheet 28 is landed first on the transport belt 42 substantially no wrinkles will develop in the sheet 20. In particular the lifting parts 130*a*, 130*b* correct any downward curl deformation of the sheet by lifting both side edge portions 26 while the middle portion 28 of the sheet is allowed to land on the support surface of the transport belt 42 of the receiving conveyor 40.

A length of the lifting plates 130*a*, 130*b* in the transport direction S increases towards the side of the transport path. As a result a height in the direction L of a rear edge 136 of the lifting plates 130*a*, 130*b* increases towards the side of the transport path and, accordingly, the side edges of the sheet 20 are lifted above the other parts of the sheet 20, while the sheet 20 is moved over the sheet guidance unit 100.

In this embodiment a rear edge 136 of both lifting part 130*a*, 130*b*, wherein rear is defined relative to the transport direction S, is arranged inclined in the transport direction S towards the side of the transport path. As a result, also a trailing edge of the sheet 20 is guided, such that at the trailing edge the middle portion of the sheet 28 lands on the support surface 43 of the receiving conveyor 40 prior to the landing of the side edge portions of the sheet 26 on support surface 43 of the receiving conveyor 40. This improves reduction of wrinkling at a trailing part of the sheet 20.

As shown in FIG. 3B the guidance surface 120 further comprises a separation edge 112 arranged for separating the leading edge 22 of the sheet 20 from the transport belt 11. The separation edge 112 may be arranged contacting the support surface 14 of the transport belt 11 or may be arranged at a close distance of the transport belt 11, such as about 0.1-1 mm from the transport belt 11, downstream of the deflection element 13*c*. The separation edge 112 has a tapered shape for guiding the leading edge 22 of the sheet onto the sheet guidance unit 100.

In case corners of the sheet 20 at the leading edge 22 are curled downwards towards the transport belt 11, the separation edge 112 guides the corners of the sheet 20 onto the guidance surface 120 of the sheet guidance unit 100.

In the embodiment shown in FIGS. 3A-3B the lifting elements 130*a*, 130*b* are arranged partly over the support surface 43 of the transport belt 42 of the receiving conveyor 40. In a modified embodiment of the embodiment shown in FIGS. 3A-3B, the guidance surface 120 extends over the width of the sheet guidance unit 100 in the transverse direction Y for guiding the sheet including the side edge portions 26 of the sheet in the transport direction S. The guidance surface 120 guides the side edge portions 26 of the sheet in the transport direction S towards the lifting parts 130*a*, 130*b*.

The lifting parts 130*a*, 130*b* are arranged fully extending in the transport direction S over the support surface 43 of the receiving conveyor 40. The guidance surface 120 is arranged extending partly over the support surface 43 of the receiving conveyor 40 in the transport direction S.

Each of the two lifting parts 130*a*, 130*b* has a tilting axis t and comprises hinges arranged for connecting the respective lifting part 130*a*, 130*b* to the guidance surface 120. The tilting axis t is arranged offset and downstream in the transportation direction S relative to the separation edge 112 of the guidance surface 120. The tilting axis t is arranged in the plane of the guidance surface 120 at an angle $\alpha$ with respect to the transport direction S for gradually lifting the side edge portions 26 away from the support surface 43, wherein the angle $\alpha$ is preferably an acute angle $\alpha$ with respect to the transport direction S.

This arrangement of the guidance surface 120 is advantageous for bridging a gap between the supplying conveyor 10 and the receiving conveyor 40, while the lifting parts 130*a*, 130*b* provide the lifting of the side edge portions 26 of the sheet above the support surface 43 of the receiving conveyor 40. In this way, the landing and the attraction of the middle portion 28 of the sheet onto the support surface 43 is provided prior to the landing and the attraction of the side edge portions 26 of the sheet onto the support surface 43 of the receiving conveyor 40.

Figure 4:
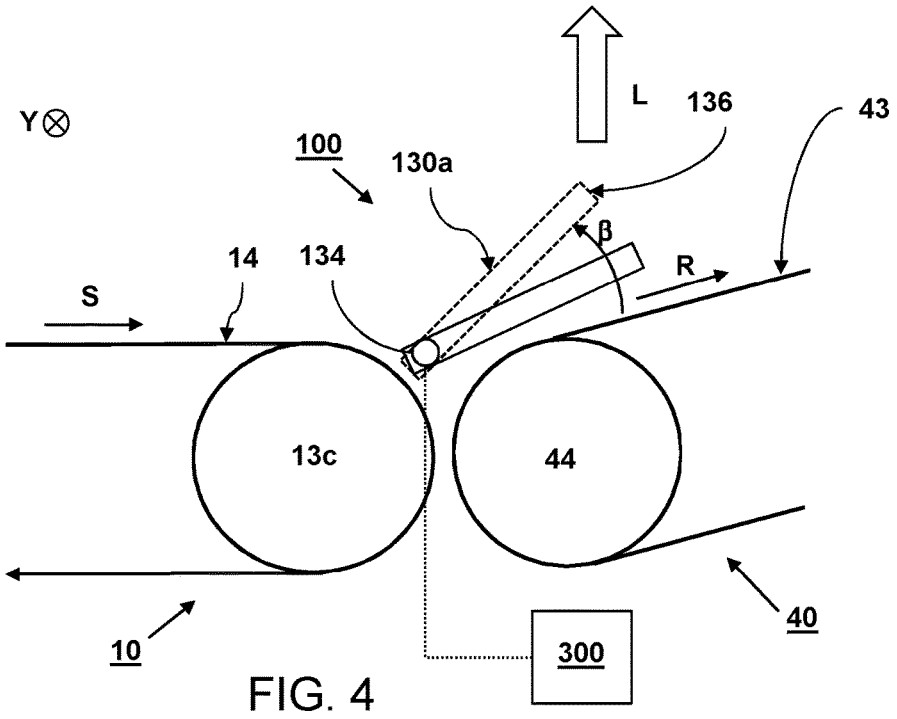
FIG. 4 shows a modified embodiment of the sheet conveyor shown in FIGS. 2A-2C.

Now referring to FIG. 4 wherein a modified embodiment is shown of the sheet conveyor shown in FIGS. 2A-2C. FIG. 4 shows schematically a part of the sheet conveyor in a side view of the sheet guidance unit 100, showing a first one of the two lifting parts 130*a*. The lifting part 130*a* is rotatably supported by an axle 134, which axle 134 extends in the transverse direction Y perpendicular to the transport direction S. In this embodiment the axle 134 coincides with the tilting axis t of the lifting part 130. The lifting part 130*a* is rotated around its tilting axis t by a rotational movement of the axle 134.

An actuator is connected to the axle 134 for rotating the axle 134 such that the lifting part 130*a* is rotated for arranging the lifting part 130*a* around its tilting axis t at a predetermined tilting angle with respect to the support surface 43 as indicated by arrow $\beta$. As a result the side edge portions of the sheet 26 may be lifted away from the support surface 43 (as indicated by arrow L) based on the tilting angle $\beta$ of the lifting part 130*a* and the length of the lifting part 130*a* between the tilting angle 134 and a rear edge of the lifting part 136.

The actuator is controlled by the control unit 300 for adjusting the tilting angle $\beta$ of the lifting part 130*a*. The tilting angle $\beta$ may be adjusted by the control unit 300 in response to a sheet attribute, such as a sheet material, a sheet process parameter, such as a transport speed of the sheet and an ink coverage of the sheet, or in response to any other property relating to sheet wrinkling on the support surface 43 of the receiving conveyor 40.

In this embodiment each lifting part 130*a*, 130*b* is supported by a separate axle 134 and, as such, each lifting part 130*a*, 130*b* may be rotatably adjusted around its respective tilting axis independently of each other.

Alternatively the axle 134 may extend in the transverse direction Y along the transport path and may be connected to both lifting parts 130*a*, 130*b* for rotatably arranging both lifting parts 130*a*, 130*b*. As such the axle 134 may be rotated for synchronously arranging both lifting parts 130*a*, 130*b* at a predetermined tilting angle $\beta$.

Figure 5:
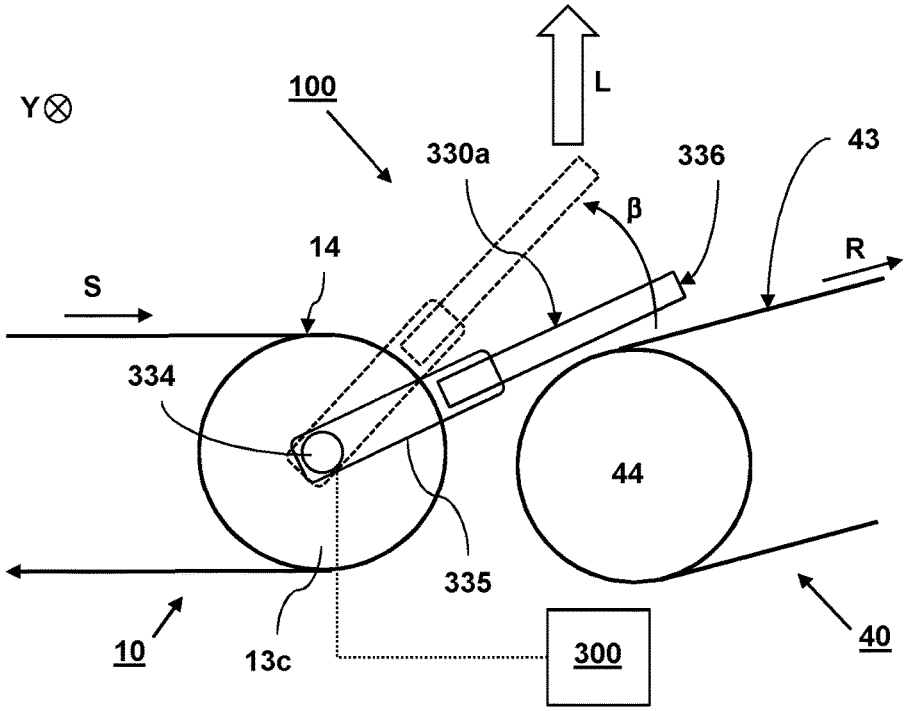
FIG. 5 shows a modified embodiment of the sheet conveyor shown in FIG. 4.

Now referring to FIG. 5 wherein a modified embodiment is shown of the sheet conveyor shown in FIG. 4. FIG. 5 shows schematically a part of the sheet conveyor in a side view of the sheet guidance unit 100, showing a first one of the two lifting parts 330*a*. The lifting part 330*a* is rotatably supported by an axle 334, which axle 334 extends in the transverse direction Y perpendicular to the transport direction S. In this embodiment the axle 334 forms a tilting axis t of the lifting part 330*a* and coincides with an axle of the deflection roller 13*c*. The lifting part 330*a* is connected via a plate 335 to the axle 334 at one side of the lifting part 330*a* outside of the transport path of the sheet 20.

An actuator is connected to the axle 334 for rotating the axle 334 such that the lifting part 330*a* is rotated for arranging the lifting part 330*a* around its tilting axis t at a predetermined tilting angle with respect to the support surface 43 as indicated by arrow β. As a result the side edge portions of the sheet 26 may be lifted away from the support surface 43 (as indicated by arrow L) based on the tilting angle β of the lifting part 330*a* and the length of the lifting part 330*a* between the tilting angle 334 and a rear edge of the lifting part 336. Furthermore in this embodiment a distance between the lifting part 330*a* and the transport belt 11 at the deflection roller 13*c* is substantially constant independently of the tilting angle β of the lifting part 330*a*.

The actuator is controlled by the control unit 300 for adjusting the tilting angle β of the lifting part 330*a*. The tilting angle β may be adjusted by the control unit 300 in response to a sheet attribute, such as a sheet material, a sheet process parameter, such as a transport speed of the sheet and an ink coverage of the sheet, or in response to any other property relating to sheet wrinkling on the support surface 43 of the receiving conveyor 40.

In an alternative embodiment, the embodiment shown in FIG. 4 or the embodiment shown in FIG. 5 is modified by adding a spring mechanism instead of the actuator to the sheet guidance unit. Said spring mechanism is a torsion spring, which is connected to the axle 134, 334 respectively for positioning the lifting part 130*a*,330*a* respectively at a predetermined angle β around the tilting axis t with respect to the support surface 43. Said predetermined angle β is selected for lifting a relatively flexible sheet away from the support surface 43, such that no wrinkling will occur in the sheet 20 after landing on the support surface 43 of the receiving conveyor 40. The torsion spring has a predetermined spring force acting on the shaft 134, 334 in the angular direction away from the support surface 43 as indicated by arrow β. The predetermined spring force is selected sufficiently high, such that a relatively flexible sheet 20, which contacts the sheet guidance unit 100 during transport to the receiving conveyor 40, does not reduce the predetermined angle. Furthermore the selected predetermined spring force is sufficiently low, such that a relatively stiff sheet 20, which contacts the sheet guidance unit 100 during transport to the receiving conveyor 40, urges the lifting part 130*a*, 330*a* towards the support surface 43. As a result the angle β of the lifting part 130*a*, 330*a* with respect of the support surface 43 is temporarily reduced by the moving relatively stiff sheet 20, while guiding the relatively stiff sheet 20 to the support surface 43. Thus the lifting part 130*a*, 330*a* is elastically urged by the torsion spring towards the predetermined angle β with respect to the support surface 43. The predetermined spring force is selected, such that the angle β of the lifting part 130*a*, 330*a* is elastically adjusted with respect to the support surface 43 depending on the sheet type.

It has been found that a relatively stiff sheet 20 has fewer problems with wrinkling, as the relatively stiff sheet 20 has a lower tendency to curl. In case of the relatively stiff sheet 20, the transport friction of the relatively stiff sheet 20 to the sheet guidance unit 100 is reduced in response to a lower angle of the lifting part 130*a*, 330*a*, with respect to the support surface 43. As such the transport accuracy of a relatively stiff sheet 20 along the sheet guidance unit 100 is improved, while reducing or preventing wrinkling of various sheet types on the receiving conveyor 40.

Figure 6:
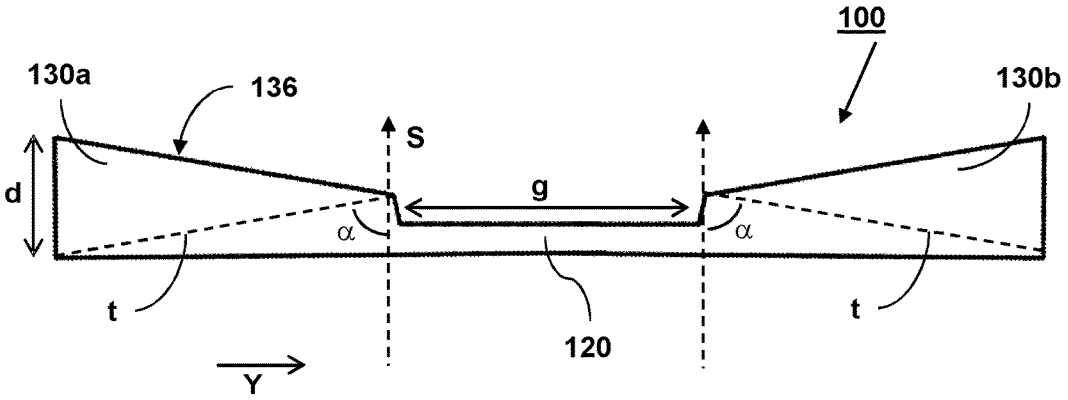
FIG. 6 shows a modified embodiment of the sheet guidance unit of the sheet conveyor shown in FIG. 3B.

Now referring to FIG. 6, wherein a modified embodiment of the sheet guidance unit is shown of the sheet conveyor shown in FIG. 3B. FIG. 6 schematically shows a plane view on the guidance surface 120 of the sheet guidance unit 100, which can be used in the sheet conveyor of FIGS. 3A-3B. The sheet guidance unit 100 comprises two lifting parts 130*a*, 130*b* and a guidance surface 120. Each of the lifting parts 130*a*, 130*b* is a lifting plate comprising a tilting axis t, which is arranged at an acute angle α with respect to the sheet transport direction S in a plane parallel to the transport path for gradually lifting side edge portions of the sheet (shown in FIG. 3B). Each of the lifting parts 130*a*, 130*b* has a length d in the direction of the transport direction S, which length d increases towards the side of the transport path. The guidance surface 120 has a rear edge, which rear edge is arranged offset and upstream in the transport direction S with respect to the rear edges 136 of the lifting parts 130*a*, 130*b* in order to provide an opening extending over a distance g in the transverse direction between the two lifting parts 130*a*, 130*b*. Herein rear is defined relative to the transport direction S.

The opening between the two lifting parts 130*a*, 130*b* and the acute angle α of each lifting part 130*a*, 130*b* cooperatively enhance the guiding of the middle portion of the sheet towards the support surface of the receiving conveyor, while the side edge portions of the sheet are lifted away from the support surface of the receiving conveyor.

In all of the embodiments shown in FIGS. 2A-2C, FIGS. 3A-3B, FIG. 4, FIG. 5 and FIG. 6, a rear edge 136, 336 of both lifting part 130*a*, 130*b* is arranged inclined in the transport direction S towards the side of the transport path. Herein rear is defined relative to the transport direction S. As a result, also a trailing edge of the sheet 20 is guided, such that at the trailing edge the middle portion of the sheet 28 lands on the support surface 43 of the receiving conveyor 40 prior to the landing of the side edge portions of the sheet 26 on support surface of 43 the receiving conveyor 40.

In all of the embodiments shown in FIGS. 2A-2C, FIGS. 3A-3B, FIG. 4 and FIG. 5, the sheet 20 is transported by the receiving conveyor 40 in the transport direction R along a second transport path, which is arranged at an acute angle with respect to the transport path of the supplying conveyor 10 in the plane of the lifting direction L and the transport direction S. Said acute angle is preferably at least 20 degrees, more preferably at least 30 degrees, relative to the transport direction S. Said acute angle further improves the reduction of wrinkling of the sheet 20 on the receiving conveyor.

In all of the embodiments shown in FIGS. 2A-2C, FIGS. 3A-3B, FIG. 4, FIG. 5 and FIG. 6, the lifting parts 130*a*, 130*b* and/or the guidance surface 120 comprises a friction reducing part for reducing friction to the contact side 21 of the sheet 20. The friction reducing part preferably comprises an assembly of protrusions formed on the surface, such as a rigidized surface structure, for guiding the contact side 21 of the sheet 20.

Alternatively or additionally to said assembly of protrusions, the friction reducing part may comprise a friction reducing coating, such as a coating containing a silicon and/or a perfluoropolyether component, for guiding the contact side 21 of the sheet 20. In another embodiment the friction reducing part comprises a plurality of rollers provided on the surface for guiding the contact side 21 of the sheet 20.

In all of the embodiments shown in FIGS. 2A-2C, FIGS. 3A-3B, FIG. 4 and FIG. 5, the transport belt 42 of the receiving conveyor 40 may be modified to be a rotatable drum comprising an outer circumferential surface for supporting the sheet 20. Said outer circumferential surface may comprise holes for providing a suction force to the sheet for attracting the sheet to the outer circumferential surface of the drum. The rotatable drum may be part of a drying unit, which further comprises heating units for heating the sheet, which is supported on the rotatable drum.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet conveyor for transporting a sheet, the sheet conveyor comprising a supplying conveyor, a receiving conveyor and a sheet guidance unit; the receiving conveyor comprising a support surface arranged for supporting the sheet on a contact side of the sheet and an attraction unit arranged for attracting the sheet to the support surface;

the supplying conveyor being arranged for advancing the sheet in a transport direction along a transport path towards the support surface of the receiving conveyor;

the sheet having two side edge portions relative to the transport path; and the sheet guidance unit being arranged at a downstream end of the transport path for guiding the sheet towards the receiving conveyor, wherein said sheet guidance unit comprises a lifting element arranged for lifting both side edge portions at a leading edge of the sheet away from the support surface while a middle portion at the leading edge of the sheet in between both side edge portions is guided towards the support surface, wherein the guidance unit is arranged partly over the support surface of the receiving conveyor.

2. The sheet conveyor according to claim 1, wherein the lifting element comprises two lifting parts cooperatively arranged along the sides of the transport path for lifting both side edge portions of the sheet away from the support surface.

3. The sheet conveyor according to claim 2, wherein a length of a first lifting part in the transport direction increases towards the side edge of the transport path.

4. The sheet conveyor according to claim 2, wherein a first lifting part is tilted around a tilting axis with respect to the support surface, wherein the tilting axis is arranged substantially parallel to the plane of the transport path at an angle with respect to the transport direction for gradually lifting a first side edge portion.

5. The sheet conveyor according to claim 4, wherein the first lifting part is rotatably arranged around the tilting axis and the sheet guidance unit comprises an adjusting device arranged for adjusting a tilting angle of the first lifting part around the tilting axis with respect to the support surface.

6. The sheet conveyor according to claim 4, wherein the tilting axis of the first lifting part is arranged substantially perpendicular to the transport direction.

7. The sheet conveyor according to claim 4, wherein the tilting axis of the first lifting part is arranged at an acute angle with respect to the transport direction.

8. The sheet conveyor according to claim 2, wherein the lifting parts are arranged at a position along the support surface of the receiving conveyor, such that the middle portion of the sheet is guided towards said support surface, while at the same position in the transport direction the side edge portions of the sheet are lifted by the respective lifting parts away from said support surface.

9. The sheet conveyor according to claim 2, wherein the lifting parts are arranged in part above the support surface of the receiving conveyor.

10. The sheet conveyor according to claim 8, wherein the lifting parts are further arranged such that the middle portion of the sheet at its leading edge first contacts the support surface, while the side edge portions at its leading edge land on the support surface downstream in the transport direction at a certain distance relative to the middle portion.

11. The sheet conveyor according to claim 1, wherein the supplying conveyor comprises a transport belt for advancing the sheet in the transport direction along the transport path and a deflection element arranged at the downstream end of the transport path for deflecting the transport belt close to the sheet guidance unit.

12. The sheet conveyor according to claim 11, wherein the sheet guidance unit comprises a separation edge for separating the sheet from the transport belt, which separation edge is arranged at a distance of about 1 mm or less from the transport belt.

13. The sheet conveyor according to claim 1, wherein the sheet guidance unit comprises a friction reducing part arranged for reducing friction to the sheet.

14. The sheet conveyor according to claim 1, wherein the support surface of the receiving conveyor is arranged for transporting the sheet along a second transport path arranged at an acute angle with respect to the transport path of the supplying conveyor.

15. An inkjet printing apparatus for printing on a sheet, comprising:

an inkjet print head assembly arranged for applying an inkjet image on the sheet;

and a sheet conveyor according to claim 1, wherein the sheet guidance unit is arranged downstream of the inkjet print head assembly.

16. The inkjet printing apparatus according to claim 15, wherein the receiving conveyor is part of a drying unit arranged for drying the sheet supported on the receiving conveyor.

17. The sheet conveyor according to claim 1, wherein the lifting element is arranged for lifting both side edge portions of the sheet away from the support surface while a middle portion of the sheet in between both side edge portions is guided towards the support surface, such that the side edge portions of the sheet land onto the support surface of the receiving conveyor a certain distance further in the transport direction compared to where the middle portion of the sheet was attracted onto the support surface of the receiving conveyor.

18. A method for transporting a sheet in a sheet conveyor, the sheet conveyor comprising a supplying conveyor and a receiving conveyor, the method comprising the steps of:

a) advancing the sheet arranged on the supplying conveyor along a transport path in a transport direction to the receiving conveyor;

b) guiding the sheet towards a support surface of the receiving conveyor; and c) attracting the sheet onto the support surface while advancing the sheet by a movement of the support surface of the receiving conveyor along a second transport path;

wherein the guiding step comprises a step of lifting both side edge portions at a leading edge of the sheet away from the support surface of the receiving conveyor, the two side edge portions of the sheet being relative to the transport path, while guiding a middle portion at the leading edge of the sheet in between both side edge portions towards the support surface, such that the middle portion of the sheet at its leading edge first contacts the support surface, while the side edge portions at its leading edge land on the support surface downstream in the transport direction at a certain distance relative to the middle portion.

* * * * *